US005682770A

United States Patent [19]

Wang

[11] Patent Number: 5,682,770

[45] Date of Patent: Nov. 4, 1997

[54] JACQUARD MECHANISM OF A CIRCULAR KNITTING MACHINE

[76] Inventor: Ping-Shin Wang, No. 22, Lane 21, San-Chung Rd., Nan-Kang Dist., Taipei, Taiwan

[21] Appl. No.: 691,392

[22] Filed: Aug. 2, 1996

[51] Int. Cl.[6] ..... D04B 15/32

[52] U.S. Cl. ..... 66/57; 66/19; 66/38

[58] Field of Search ..... 66/57, 38, 20, 66/19, 40, 78, 204, 82 A, 222, 223, 224

[56] References Cited

U.S. PATENT DOCUMENTS 3,795,119 3/1974 Bourgeois ..... 66/20

4,040,274 8/1977 Christopoulos ..... 66/57

4,596,981 6/1986 Lida ..... 66/20

5,526,655 6/1996 Lida ..... 66/57

*Primary Examiner*—C. D. Crowder

*Assistant Examiner*—Larry D. Worrell, Jr.

*Attorney, Agent, or Firm*—Bacon & Thomas

[57] ABSTRACT

A jacquard mechanism mounted in a circular knitting machine for knitting a jacquard fabric, including a fixed selector cam for guiding a knitting needle in a fixed track, a needle selector controlled to raise the knitting needle into a tucking track for a jacquard knitting operation, a movable selector cam moved in a sliding slot in the fixed selector cam to open/close the tucking track, and a driving mechanism controlled to move the movable selector cam in the sliding slot of the fixed selector cam.

5 Claims, 6 Drawing Sheets

JACQUARD MECHANISM OF A CIRCULAR KNITTING MACHINE

BACKGROUND OF THE INVENTION

The present invention relates to circular knitting machines, and relates more specifically to the jacquard mechanism of a circular knitting machine for selectively guiding jacquard needles into a jacquard knitting position or a plain knitting position.

It is well known to install a needle selector in a circular knitting machine for selectively raising the knitting needles or sinkers for knitting piled, eyed, patterned jacquard fabrics. The knitting needles or sinkers are respectively moved on a respective selector cam in the idle position or plain knitting position. When it is desired to knit a jacquard fabric, the knitting needles or sinkers must be moved on the respective cams to a jacquard knitting position. Conventionally, when moving the knitting needles to a different knitting position, the jacquard mechanism must be adjusted, and the cams must be changed. Because a circular knitting machine comprises a plurality of cams, it consumes much labor and time to change the cams. U.S. Pat. No. 4,956,981 discloses a circular knitting machine with a multiple number of feeds, in which each feed of the multiple feed circular knitting machine provided with selector cams to position needles one of four positions, knit; tuck, welt and early withdrawal positions. The selector cams are mounted on rotatable selector cam cylinders which are positioned to overlap each other to permit the selector cams to be arranged at the closest possible lateral distance from each other and to thereby permit an increased number of feeds to be positioned around the machine. This design does not need to change the selector cams to lift the needles to the desired elevation. However, because the selector cams are mounted on rotatable selector cam cylinders, it consumes much labor to adjust the rotatable selector cam cylinders.

SUMMARY OF THE INVENTION

The present invention has been accomplished to provide a circular knitting machine with a jacquard mechanism which eliminates the aforesaid drawbacks. According to one aspect of the present invention, the jacquard mechanism comprises a fixed selector cam for guiding a knitting needle in a fixed track, a needle selector controlled to raise the knitting needle into a tucking track for a jacquard knitting operation, a movable selector cam moved in a sliding slot in the fixed selector cam to open/close the tucking track, and a driving mechanism controlled to move the movable selector cam in the sliding slot of the fixed selector cam. Therefore, the knitting needle can be lifted to the elevation of the jacquard knitting position without changing the selector cams. According to another aspect of the present invention, the driving mechanism comprises a servo motor controlled by a computer or digital controller, and a crank coupled between the servo motor and the movable selector cam.

DETAILED DESCRIPTION OF THE PREFERRED EMBODIMENT

Figure 3B:
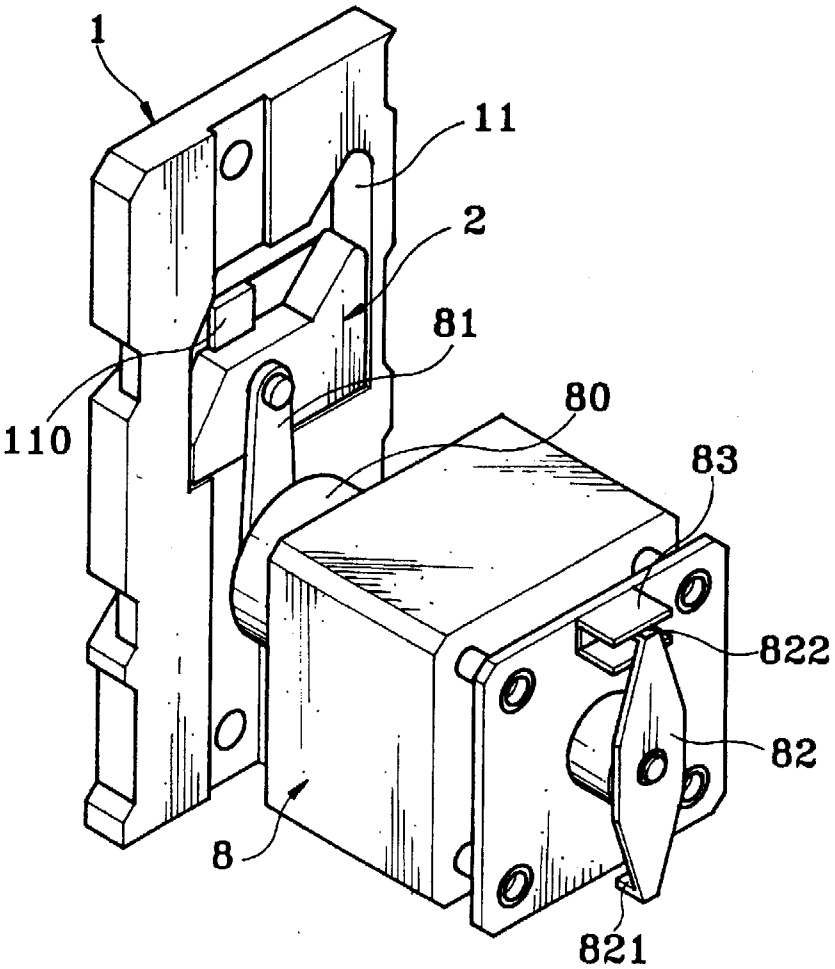
FIG. 3B is a view similar to FIG. 3A but showing the movable selector cam moved to the lower limit position in the sliding slot of the fixed selector cam.
Figure 3A:
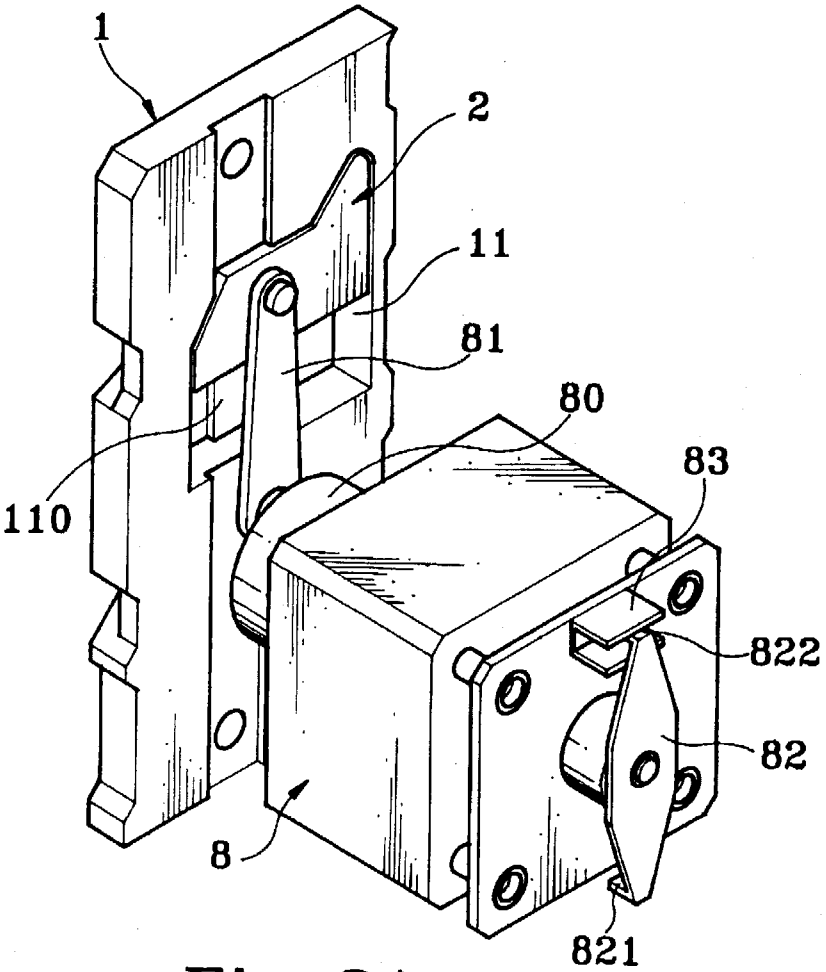
FIG. 3A is perspective view of the present invention, showing the movable selector cam moved to the upper limit position in the sliding slot of the fixed selector cam.

Referring to FIG. 3A, a jacquard mechanism in accordance with the present invention is generally comprised of a fixed selector cam 1, a movable selector cam 2, and a driving mechanism adapted for driving the movable selector cam 2.

Figure 1:
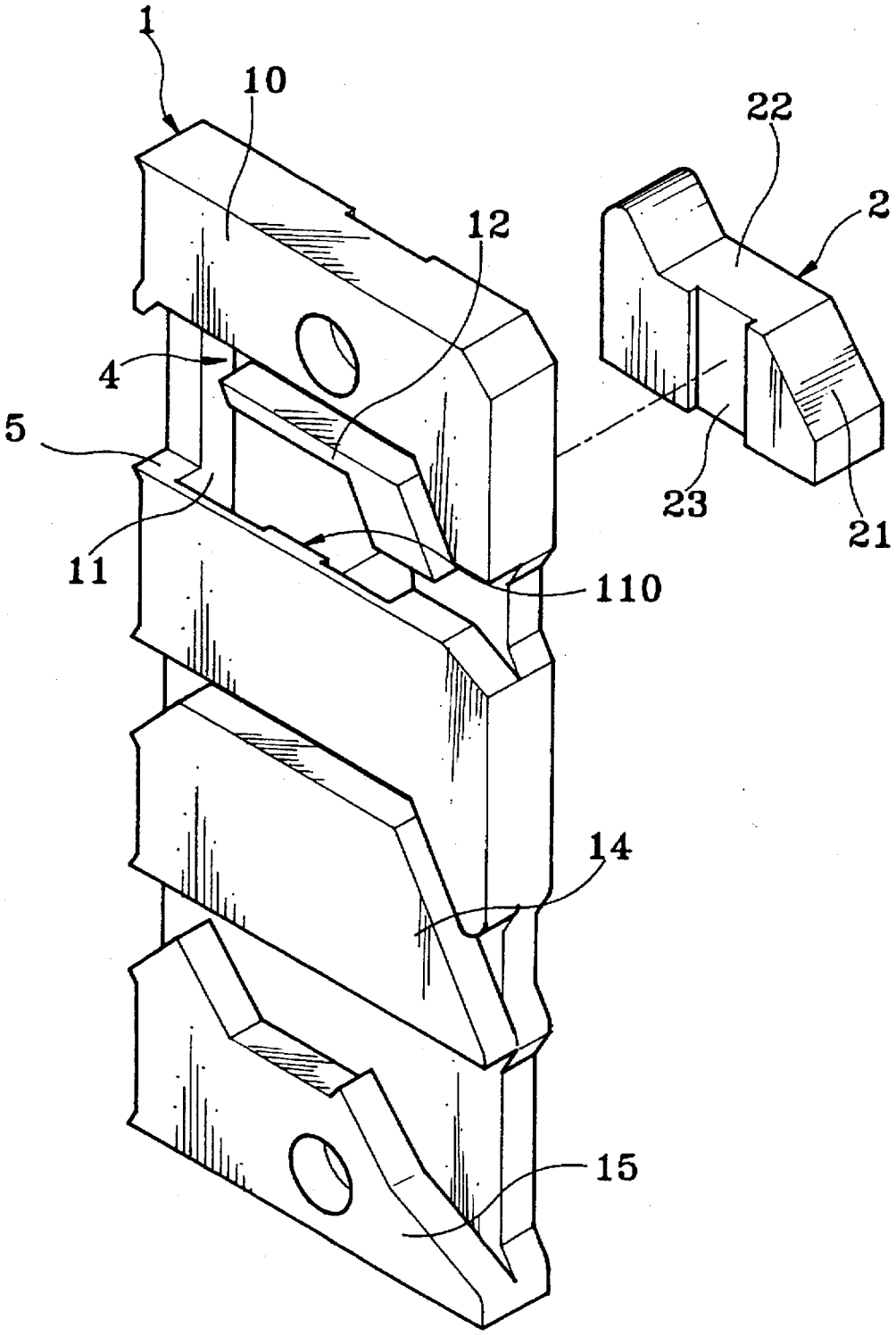
FIG. 1 is a perspective view showing the relationship between the fixed selector cam and the movable selector cam according to the present invention.
Figure 5:
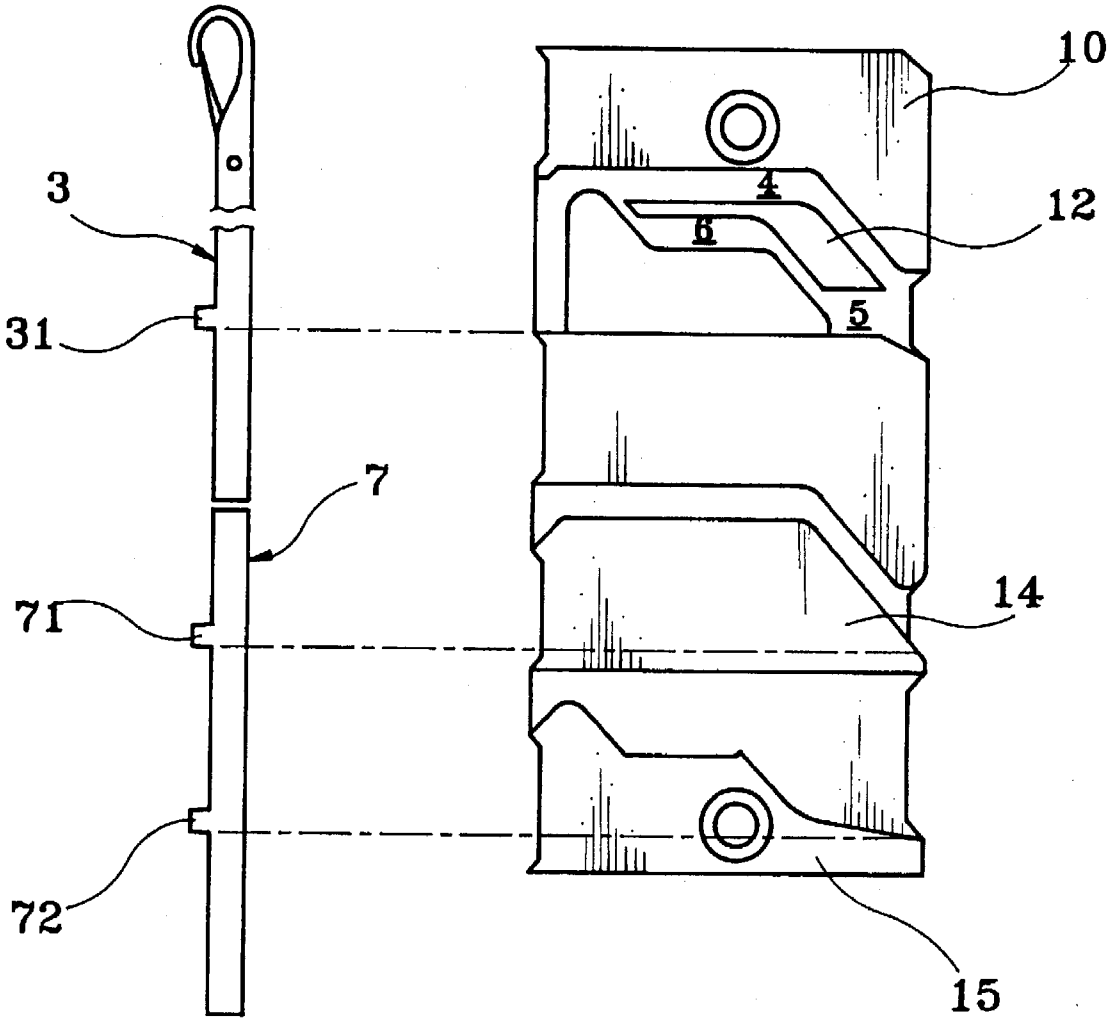
FIG. 5 is a schematic drawing showing the welting position of the knitting needle relative to the movable selector cam according to the present invention.

Referring to FIG. 1, the fixed selector cam 1 is mounted on the outside of the periphery of the cylinder of the circular knitting machine, having a plurality of tracks at the inner side 10 for the insertion of the needle butt 31 of the knitting needle 3 (see also FIG. 5). These tracks include a knitting track 4 for raising the knitting needle 3 to the knitting position and a welting track 5 for keeping the knitting needle 3 in the welting position. The knitting track 4 and the welting track 5 are recessed tracks formed in the inner side 10 of the fixed selector cam 1. When a plurality of fixed cams 1 are arranged around the periphery of the cylinder of the circular knitting machine, the knitting tracks 4 and welting tracks 5 of the fixed cams 1 are respectively connected together. When the fixed cams 1 are moved relative to the cylinder of the circular knitting machine, the knitting needles 3 are moved up and down along the knitting tracks 4 or welting tracks 5 of the fixed cams 1 to push the thread through the fabric or to cast off a loop.

Figure 2:
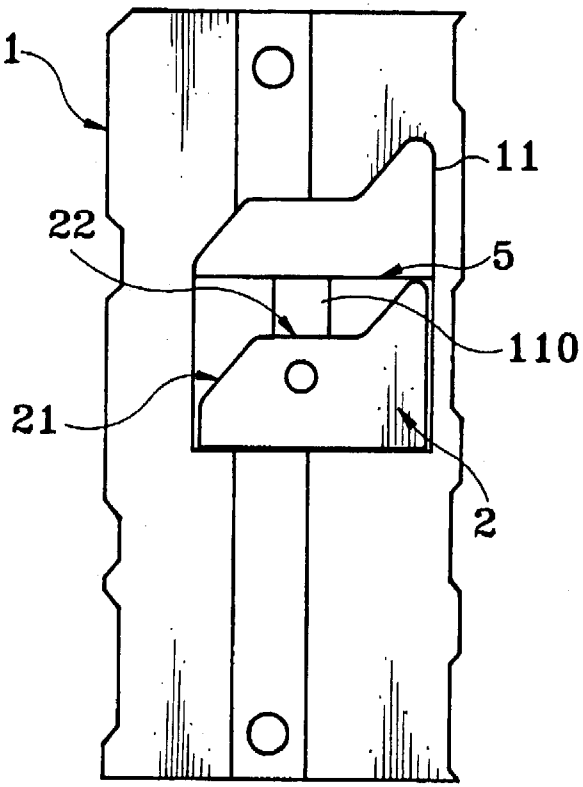
FIG. 2 is a rear view showing the back side structure of the fixed selector cam according to the present invention.

The movable selector cam 2 moves vertically in a slot 11 at the outer side of the fixed selector cam 1. FIG. 3A shows the movable selector cam 2 moved to the top side in the slot 11 of the fixed selector cam I. FIG. 3B shows the movable selector cam 2 moved to the bottom side in the slot 11 of the fixed selector cam 1. When the movable selector cam 2 is moved in the slot 11 to a higher elevation above the position shown in FIG. 3B, a tucking track 6 is defined in the fixed selector cam 1. The fixed selector cam 1 further comprises a vertical rail 110 disposed in the slot 11 for guiding the movement of the movable selector cam 2. The movable selector cam 2 comprises a vertical sliding groove 23 at one side coupled to the vertical rail 110 of the fixed selector cam 1, a sloping front surface 21 adapted for lifting the knitting needle 3 to the tucking position, a horizontal top surface 22 adapted for holding the knitting needle 3 in the tucking position as best seen in FIGS. 1 and 2. When the movable selector cam 2 is lifted to the elevation of the tucking position, the horizontal top surface 22 and sloping front surface 21 of the movable selector cam 2 define with the projecting plate 12 of the fixed selector cam 1 a space for the butt 31 of the knitting needle 3 to pass. This space is the aforesaid tucking track 6.

Figure 4:
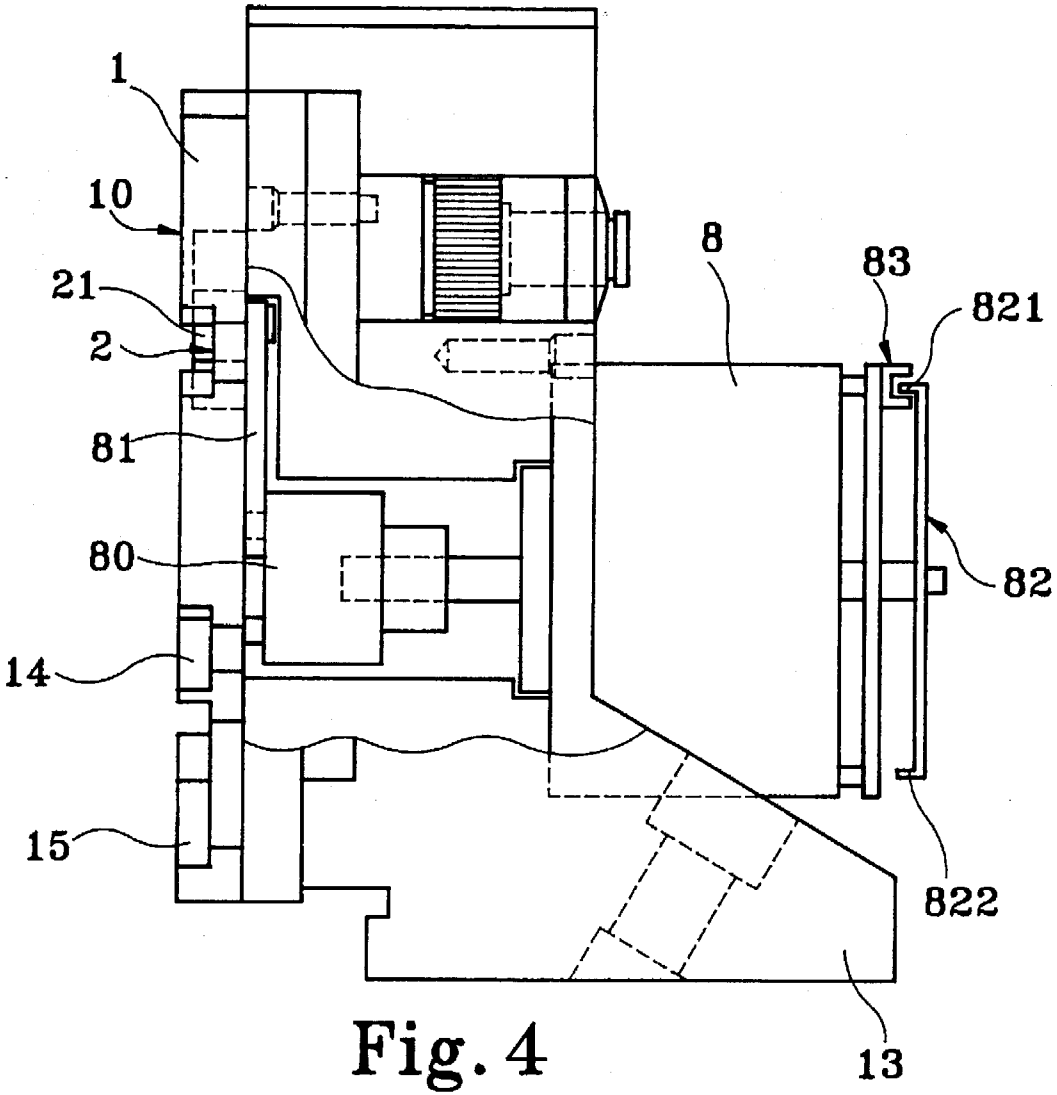
FIG. 4 is an elevational view of the present invention, showing the jacquard mechanism mounted on a seat in the circular knitting machine.

Referring to FIG. 4, the fixed selector cam 1 and the movable selector cam 2 are arranged on a seat 13, which is fixed to the frame of the circular knitting machine at a suitable location. The seat 13 is equipped with a driving mechanism for moving the movable selector cam 2. This driving mechanism comprises a servo motor 8, a cam wheel 80 coupled to the servo motor 8, a crank 81 having one end coupled to the cam wheel 80 and an opposite end coupled to the movable selector cam 2. Through the control of a computer or digital controller, the servo motor 8 is turned to lift the movable selector cam 2 to the elevation of the tucking track 6. A board 82 is coupled to the rear end of the output shaft of the servo motor 8, having two wings 821,822 at two opposite ends spaced 180° from each other. A position detector 83 is installed in the back side of the servo motor 8. When the cam wheel 80 is rotated through a half run, the wing 821 or 822 is moved to the position detector 83, causing the position detector 83 to be induced. The position detector 83 can be a photoelectric element or any equivalent element adapted for detecting the position of the movable selector cam 2.

Figure 6C:
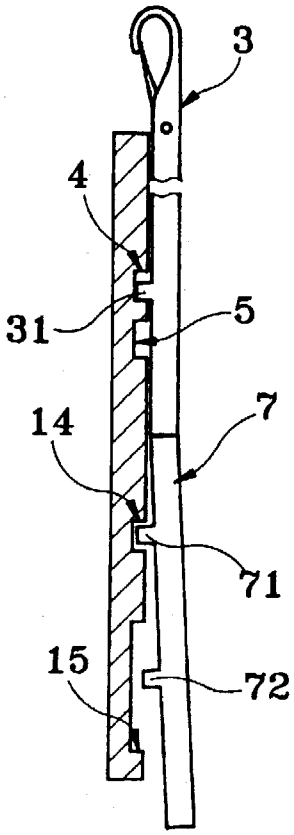
FIG. 6C is a cross-sectional view taken line VIC—VIC of FIG. 6A showing the knitting needle.
Figure 6B:
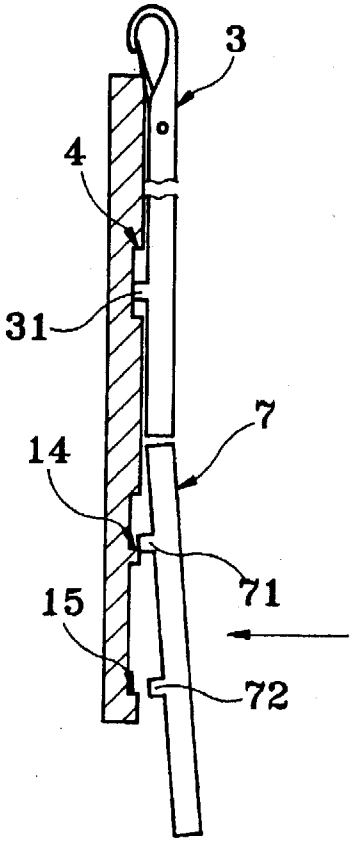
FIG. 6B is a cross-sectional view taken line VIB—VIB of FIG. A showing the knitting needle.
Figure 6A:
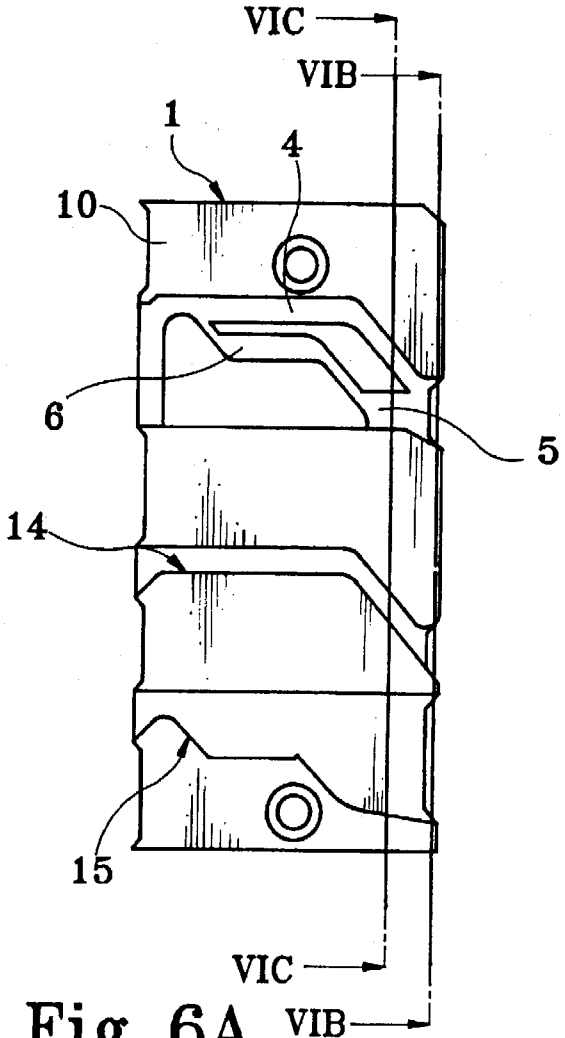
FIG. 6A is a partial view of the fixed selector cam, showing the tucking track formed according to the present invention.
Figure 7C:
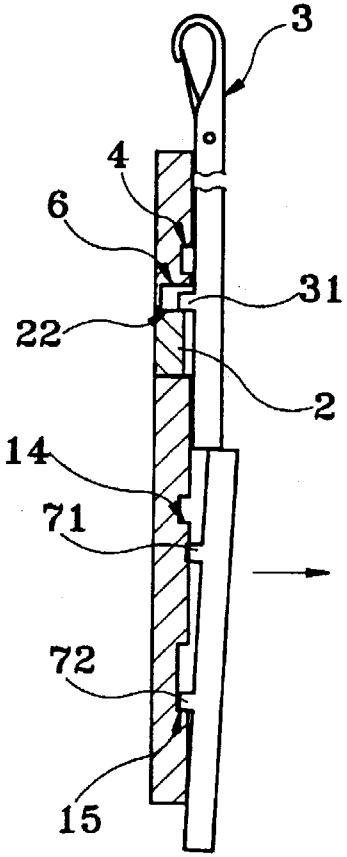
FIG. 7B is a cross-sectional view taken along the VIIB—VIIB of FIG.7A showing the knitting needle moved to the jacquard position and FIG. 7C is a cross-sectional view taken along line VIIC—VIIC of FIG. 7A showing the knitting needle moved to the jacquard position
Figure 7B:
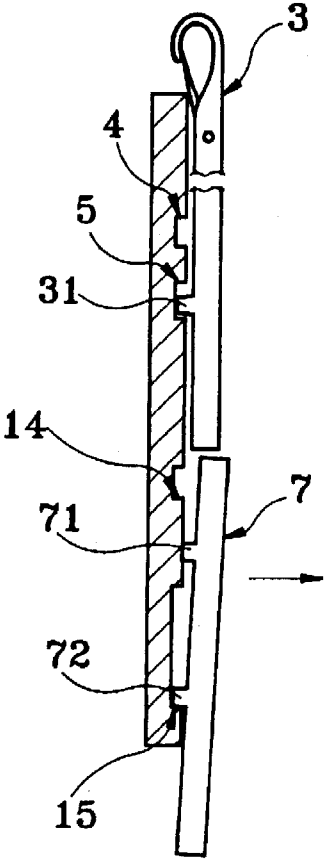
Figure 7A:
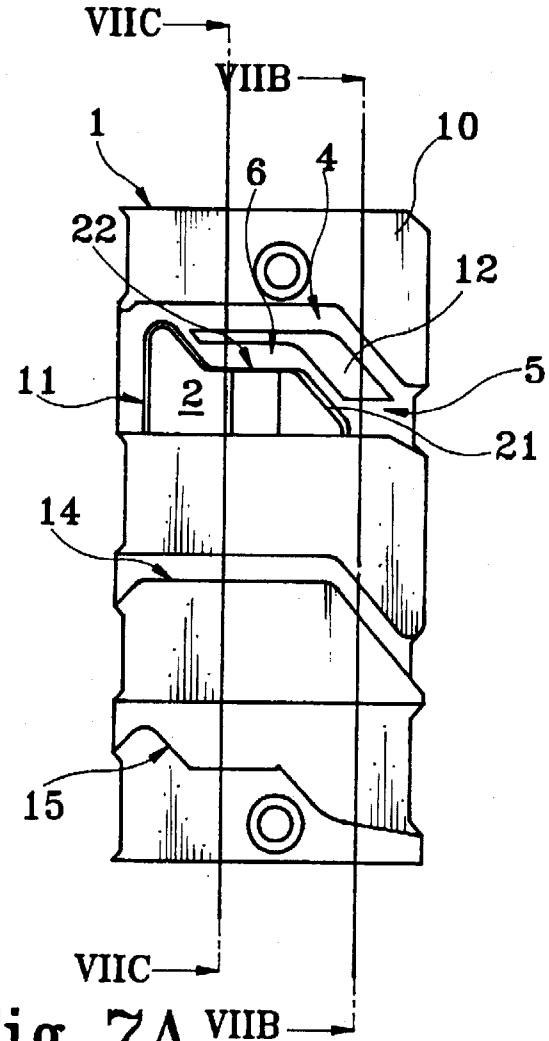
FIG. 7A is a partial view of the present invention, showing the knitting needle lifted to the jacquard knitting position.

Referring to FIG. 5, when the jack 7 is not raised by the needle selector (not shown), the butts 71, 72 of the jack 7 are spaced from the knitting control block 14 and tucking control block 15, and the butt 31 of the knitting needle 3 is forced to move along the horizontal welting track 5. On the contrary, when the jack 7 is raised by the needle selector to the tilted position shown in FIG. 6B, the upper butt 71 of the jack 7 is forced into engagement with the knitting control block 14 and lifted. When the jack 7 is lifted, the knitting needle 3 is simultaneously lifted to the knitting track 4 above the projecting plate 12 for further knitting operation. When the jack 7 is raised by the needle selector to the tilted position shown in FIG. 7B, the lower butt 72 of the jack 7 is forced into engagement with the tucking control block 15 and lifted. When the jack 7 is lifted by the tucking control block 15, the movable selector cam 2 is simultaneously lifted to the position shown in FIG. 3A, and the butt 31 of the knitting needle 3 is simultaneously moved along the sloping front surface 21 and horizontal top surface 22 of the movable selector cam 2 into the tucking track 6 for tucking operation to finish the jacquard knitting action is completed.

While only one embodiment of the present invention has been shown and described, it will be understood that various modifications and changes could be made thereunto without departing from the spirit and scope of the invention disclosed.

I claim:

1. A jacquard mechanism mounted in a circular knitting machine for knitting a jacquard fabric, comprising:

a fixed selector cam mounted in a circular knitting machine, said fixed selector cam having at least one track for guiding a knitting needle, and a sliding slot;

a movable selector cam moved in the sliding slot of said fixed selector cam between an upper position in which an auxiliary track is defined by said movable selector cam in the sliding slot of said fixed selector cam, and a lower position in which said movable selector cam blocks said auxiliary track; and a driving mechanism controlled to move said movable selector cam between said upper position and said lower position, said driving mechanism comprising a servo motor, a cam wheel turned by said servo motor, and a crank coupled between said cam wheel and said movable selector cam.

2. The jacquard mechanism of claim 1 wherein said auxiliary track comprises a tucking track defined above said movable selector cam for raising said knitting needle to a tucking position.

3. The jacquard mechanism of claim 2 wherein said movable selector cam comprises a sloping front surface configured to lift said knitting needle to said tucking position, and a horizontal top surface configured to hold said knitting needle in said tucking position.

4. The jacquard mechanism of claim 1 wherein said fixed selector cam comprises a vertical rail disposed in said sliding slot for guiding the movement of said movable selector cam; and, said movable selector cam comprises a vertical sliding groove in one side coupled to the vertical rail of said fixed selector cam.

5. The jacquard mechanism of claim 1 wherein said driving mechanism further comprises a board coupled to and turned by said servo motor and having two wings spaced 180° from each other, and a position detector mounted outside said servo motor to detect a position of said wings.

* * * * *